United States Patent [19]

Aotsuka et al.

[11] Patent Number: 4,741,996

[45] Date of Patent: May 3, 1988

[54] HEAT-DEVELOPABLE LIGHT-SENSITIVE MATERIALS HAVING IMPROVED STORAGE STABILITY

[75] Inventors: Yasuo Aotsuka; Kiyohiko Yamamuro; Takanori Hioki, all of Kanagawa, Japan

[73] Assignee: Fuji Photo Film Co., Ltd., Kanagawa, Japan

[21] Appl. No.: 21,540

[22] Filed: Feb. 26, 1987

Related U.S. Application Data

[63] Continuation of Ser. No. 741,415, Jun. 5, 1985, abandoned.

[30] Foreign Application Priority Data

Jun. 5, 1984 [JP] Japan ..... 59-114734

[51] Int. Cl.[4] ..... G03C 1/08; G03C 7/26; G03C 7/32; G03C 1/02

[52] U.S. Cl. ..... 430/559; 430/569; 430/570; 430/580; 430/581; 430/590; 430/619; 430/626

[58] Field of Search ..... 430/619, 569, 570, 580, 430/581, 590, 626, 559

[56] References Cited

U.S. PATENT DOCUMENTS

| | | | |
|---|---|---|---|
| 4,183,756 | 1/1980 | Locker | 430/581 X |
| 4,193,804 | 3/1980 | Ikenoue et al. | 430/569 X |
| 4,225,666 | 9/1980 | Locker et al. | 430/569 |
| 4,332,889 | 6/1982 | Siga et al. | 430/583 |
| 4,476,220 | 10/1984 | Penfound | 430/619 X |
| 4,524,128 | 6/1985 | Edwards et al. | 430/619 X |
| 4,543,309 | 9/1985 | Hirabayashi et al. | 430/519 X |

*Primary Examiner*—Mukund J. Shan

*Attorney, Agent, or Firm*—Sughrue, Mion, Zinn, Macpeak, and Seas

[57] ABSTRACT

A heat-developable light-sensitive material comprising a support having thereon at least a light-sensitive silver halide emulsion, an organic silver salt, and a binder, wherein silver halide grains in the silver halide emulsion are formed in the presence of sensitizing dyes. This light-sensitive material is greatly improved in its storage stability.

7 Claims, No Drawings

HEAT-DEVELOPABLE LIGHT-SENSITIVE MATERIALS HAVING IMPROVED STORAGE STABILITY

This is a continuation of application Ser. No. 741,415, filed June 5, 1985, now abandoned.

FIELD OF THE INVENTION

The present invention relates to a heat-developable light-sensitive material and more particularly to a heat-developable light-sensitive material having improved storage stability.

BACKGROUND OF THE INVENTION

A photographic process using light-sensitive silver halide is widely used because it is superior to other photographic processes such as an electrophotographic process or a diazo photographic process in photographic characteristics such as sensitivity and gradation control. Recently a method of processing a silver halide light-sensitive material has been developed which makes it possible to form images in a simplified manner and quickly employing dry processing, in which the light-sensitive material is developed by heating, in place of the conventional wet processing process in which the light-sensitive material is developed using a conventional wet developer.

A heat-developable light-sensitive material is known in the art; the heat-developable light-sensitive material and a process of processing the light-sensitive material are described in, for example, *Shashin Kogaku no Kiso (Fundamentals of Photographic Engineering),* pp. 553–555 (Corona Co., Ltd., Tokyo, (1979)), *Eizo Gaho (Image Information),* page 40, (April 1978), *Nebletts Handbook of Photography and Reprography,* pp. 32–33, Van Nortrsnd Reinhold Co., 7th Ed (1977), U.S. Pat. Nos. 3,152,904, 3,301,678, 3,392,020, 3,457,075, British Patent Nos. 1,131,108, 1,167,777, and *Research Disclosure,* June 1978 (RD-17029), pp. 9–15.

Many methods are known for forming color images. One method is to form a color image by reacting an oxidation product of a developer and a coupler. Using this method, U.S. Pat. No. 3,531,286 describes p-phenylenediamine-based reducing agents and phenolic or active methylene couplers. In addition, U.S. Pat. No. 3,761,270 describes p-aminophenol-based reducing agents; Belgian Patent No. 802,519 and *Research Disclosure,* Sept. 31, 1975, page 32, disclose sulfonamidophenol-based reducing agents; and U.S. Pat. No. 4,021,240 disclose a combination of a sulfonamidophenol-based reducing agent and a fourequivalent coupler.

Another method forms positive color images by the light-sensitive silver/dye bleaching process. Useful dyes and bleaching methods are described in, for example, *Research Disclosure,* April 1976 (RD-14433), pp. 30–32, *Research Disclosure,* December 1976 (RD-15227), pp. 14–15, and U.S. Pat. No. 4,235,957.

Further, another method is to form a color image by heat development, utilizing compounds having a dye portion and capable of releasing a mobile dye in a positive or negative relation to the reduction of silver halide into silver. This method is described in U.S. Pat. Nos. 4,500,626, 4,483,114, Japanese Patent Application (OPI) Nos. 28928/83 (corresponding to U.S. patent application Ser. No. 582,655 filed on Feb. 23, 1984), and U.S. Pat. No. 4,503,137 (the term "OPI" as used herein means a "published unexamined Japanese patent application").

In these image-forming methods, organic silver salts are usually incorporated in the light-sensitive material for the purpose of accelerating heat-development. Addition of such organic silver salts, however, results in a serious disadvantage, i.e. the sensitivity of the light-sensitive material in which a silver halide emulsion sensitized with a sensitizing dye and the organic silver salt are present in combination is decreased during its storage.

SUMMARY OF THE INVENTION

An object of the present invention is to improve the storage stability of a heat-developable light-sensitive material containing an organic silver salt and a silver halide emulsion sensitized with a sensitizing dye.

It has been found that this object is attained by using a silver halide emulsion containing silver halide particles which are formed in the presence of a sensitizing dye.

The present invention relates to a heat-developable light-sensitive material comprising a support having thereon at least a light-sensitive silver halide emulsion, an organic silver salt, and a binder, wherein the silver halide emulsion contains silver halide grains are formed in the presence of a sensitizing dye.

DETAILED DESCRIPTION OF THE INVENTION

In accordance with the present invention, since silver halide grains are formed in the presence of a sensitizing dye, the sensitizing dye is adsorbed on the silver halide grains in a stabilized condition, so that the sensitivity of silver halide in its inherently sensitive range can be changed, or silver halide can be made sensitive outside its inherently sensitive range.

As sensitizing dyes, methine dyes are conventionally used, including cyanine dyes, merocyanine dyes, complex cyanine dyes, complex merocyanine dyes, holopolar cyanine dyes, hemicyanine dyes, styryl dyes, and hemioxonol dyes. Particularly preferable dyes are cyanine dyes, merocyanine dyes, and complex merocyanine dyes. In thse dyes, any nuclei which are commonly used in cyanine dyes as basic heterocyclic nuclei can be present, such as for example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus, nuclei comprising the above nuclei with alicyclic hydrocarbon rings fused thereto, and nuclei comprising the above nuclei with aromatic hydrocarbon rings fused thereto, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be applied. The carbon atoms of these nuclei may also be substituted.

In merocyanine dyes and composite merocyanine dyes, nuclei having a ketomethylene structure can be used, such as 5- or 6-membered heterocyclic nuclei, e.g., a pyrazolin-5-one nucleus, a thiohydantoin nucleus, a 2-thiooxazolidin-2,4-dione nucleus, a thiazolidin-2,4-dione nucleus, a rhodanine nucleus, and a thiobarbituric acid.

Examples of sensitizing dyes which are preferable in the present invention are represented by the following general formulae (A) to (H), (J) to (U), (W) and (Y).

Formula (A)

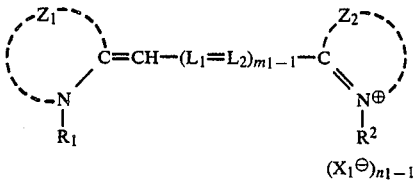

In formula (A), $Z_1$ and $Z_2$ each represents atoms to complete a heterocyclic nucleus of the type usually present in cyanine dyes, such as thiazole, thiazoline, benzothiazole, naphthothiazole, oxazole, oxazoline, benzoxazole, naphthoxazole, tetrazole, pyridine, quinoline, imidazoline, imidazole, benzimidazole, naphthoimidazole, selenazoline, selenazole, benzoselenazole, naphthoselenazole, indolenine, or like nucleus. These nuclei each may be substituted with a lower alkyl group like methyl, a halogen atom, a phenyl group, a hydroxyl group, an alkoxy group containing from 1 to 4 carbon atoms, a carboxyl group, an alkoxycarbonyl group, an alkylsulfamoyl group, an alkylcarbamoyl group, an acetyl group, an acetoxy group, a cyano group, a trichloromethyl group, a trifluoromethyl group, a nitro group, and so on.

$L_1$ and $L_2$ each represents a methine group or a substituted methine group. Suitable substituted methine groups include those substituted with a lower alkyl group like methyl, ethyl, etc., a phenyl group, a substituted phenyl group, a methoxy group, an ethoxy group, and so on.

$R_1$ and $R_2$ each represents an alkyl group containing from 1 to 5 carbon atoms, a substituted alkyl group having a carboxyl group, a substituted alkyl group having a sulfo group such as γY-sulfopropyl, δ-sulfobutyl, 2-(3-sulfopropoxy)ethyl, 2-[2-(3-sulfopropoxy)ethoxy]ethyl, 2-hydroxy.sulfopropyl, etc., an allyl group or other substituted alkyl group of the type which is usually employed as a group to be substituted at the nitrogen position of cyanine dyes. $m_1$ represents 1, 2 or 3. $X_1\ominus$ represents an acid anion group of the type conventionally employed for cyanine dyes, such as iodine ion, bromine ion, p-toluenesulfonic acid ion, perchloric acid ion, or so on. $n_1$ represents 1 or 2, and $n_1$ is 1 when the dye has a betaine structure.

Formula (B)

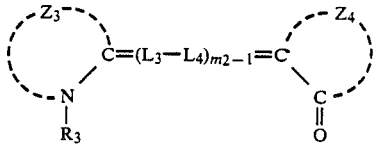

In formula (B), $Z_3$ represents a heterocyclic nucleus of the type usually present in cyanine dyes, as described above for formula (A). $Z_4$ represents atoms forming a ketohetero nucleus of the type which is usually present in merocyanine dyes, with specific examples including rhodanine, thiohydantoin, oxyindole, 2-thioxazolidinedione, 1,3-indanedione and like nuclei. $L_3$ and $L_4$ have the same meanings as $L_1$ and $L_2$ in formula (A), respectively. $R_3$ has the same meaning as $R_1$ or $R_2$ in formula (A). $m_2$ represents 1, 2, 3 or 4.

Formula (C)

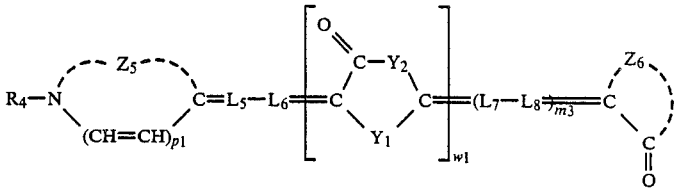

In formula (C), $Z_5$ represents atoms completing a 4-quinoline nucleus, a 2-quinoline nucleus, a benzothiazole nucleus, a benzoxazole nucleus, a naphthothiazole nucleus, a naphthoselenazole nucleus, a naphthoxazole nucleus, a benzoselenazole nucleus or an indolenine nucleus. $p_1$ represents 0 or 1. $R_4$ has the same meaning as $R_1$ or $R_2$ (in formula (A)), and $L_5$ and $L_6$ have the same meanings as $L_3$ and $L_4$ (in formula (B)), respectively. $m_3$ represents 0 or 2. $L_7$ and $L_8$ have the same meanings as $L_1$ and $L_2$ (in formula (A)), respectively. $Z_6$ has the same meaning as $Z_4$ (in formula (B)). $Y_1$ and $Y_2$ represent an oxygen atom, a sulfur atom, a selenium atom or a group of the formula $=N-R_5$ (wherein $R_5$ represents an alkyl group containing not more than 8 carbon atoms such as methyl, ethyl, propyl, etc., or an allyl group), provided that at least either $Y_1$ or $Y_2$ represents $=N-R_5$. $W_1$ represents 1 or 2.

Formula (D)

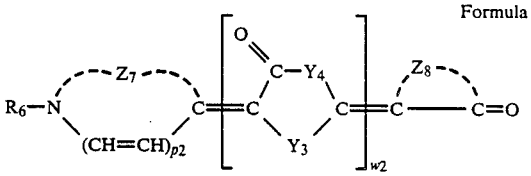

In formula (D), $Z_7$, $Z_8$, $R_6$ and $p_2$ have the same meanings as $Z_5$, $Z_6$, $R_1$ or $R_2$, and $p_1$ (as described above), respectively. $Y_3$ and $Y_4$ have the same meanings as $Y_1$ and $Y_2$ (in formula (C)), respectively. $W_2$ has the same meaning as $W_1$ (in formula (C)).

Formula (E)

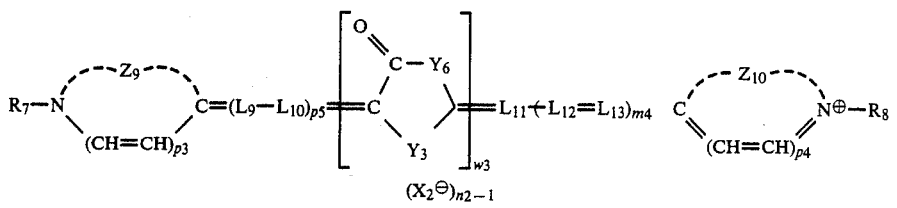

In the above formula (E), $R_7$ and $R_8$ have the same meanings as $R_1$ described above, $Z_9$ and $Z_{10}$ have the same meaning as $Z_5$ described above, $p_3$ and $p_4$ have the same meaning as $p_1$ described above, $L_9$ to $L_{13}$ have the same meanings as $L_1$ described above, $X_2\ominus$ has the same meaning as $X_1\ominus$ described above, and $n_2$ has the same meaning as $n_1$ described above. $Y_5$ and $Y_6$ have the same meaning as $Y_1$ described above. $p_5$ and $m_4$ each represents 0 or 1. $W_3$ has the same meaning as $W_1$ described above.

Formula (F)

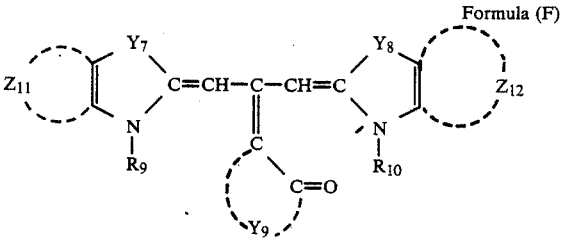

In formula (F), $Z_{11}$ and $Z_{12}$ each represents atoms completing an unsubstituted benzene ring or a substituted benzene ring, especially one which is substituted with a lower alkyl group like methyl, a halogen atom, a phenyl group, a hydroxyl group, an alkoxyl group containing from 1 to 4 carbon atoms, a carboxyl group, an alkoxycarbonyl group, an alkylsulfamoyl group, an alkylcarbamoyl group, an acetyl group, a cyano group, a trichloromethyl group, a trifluoromethyl group, a nitro group, etc., or atoms completing a naphthalene ring. $R_9$ and $R_{10}$ have the same meaning as $R_1$ (as described above). $Y_7$ and $Y_8$ each represents an oxygen atom, a sulfur atom, a selenium atom,

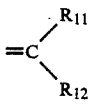

(wherein $R_{11}$ and $R_{12}$ each represents a methyl group or an ethyl group), $=N-R_{13}$ (wherein $R_{13}$ represents an unsubstituted alkyl group, a substituted alkyl group which has conventionally been employed as a substituent group present at the N-position of a cyanine dye, or an allyl group), or $-CH=CH-$. $Y_9$ represents atoms forming a 5- or 6-membered heterocyclic ring.

Formula (G)

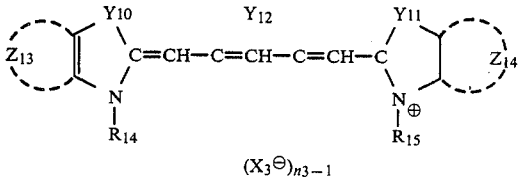

In formula (G), $Z_{13}$ and $Z_{14}$ each, $R_{14}$ and $R_{15}$ each, and $Y_{10}$ and $Y_{11}$ each have the same meanings as $Z_{11}$, $R_1$, and $Y_7$, respectively. $Y_{12}$ represents atoms forming a 5- or 6-membered carbon ring. $X_3\ominus$ and $n_3$ have the same meanings as $X_1\ominus$ and $n_1$, respectively.

Formula (H)

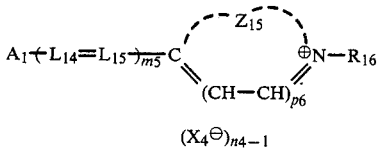

Formula (J)

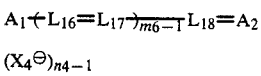

In the above formulae (H) and (J), $X_4\ominus$ and $n_4$ have the same meanings as $X_1\ominus$ and $n_1$, respectively. $p_6$ represents 0 or 1, and $m_5$ and $m_6$ each represents 1 or 2. $L_{14}$ through $L_{18}$ have the same meaning as $L_1$. $Z_{15}$ has the same meaning as $Z_1$. Preferable groups represented by $A_1$ include

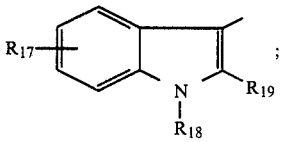

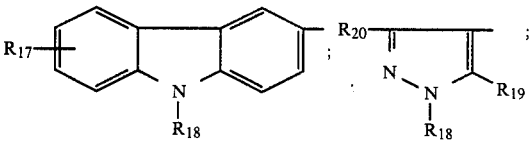

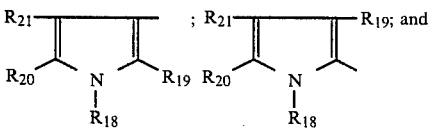

-continued

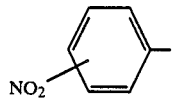

Preferable groups represented by $A_2$ include

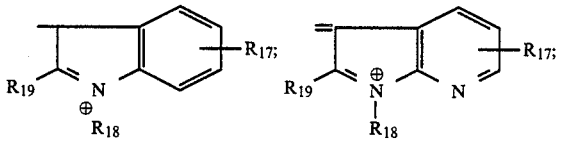

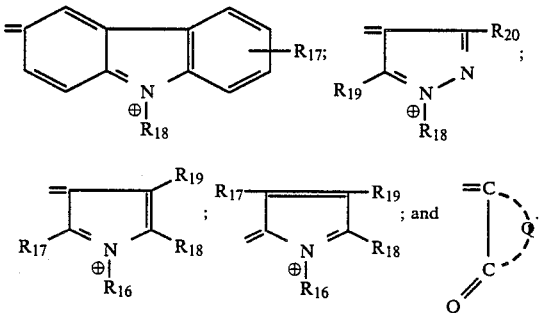

Therein, $R_{16}$ and $R_{18}$ each represents a hydrogen atom, an alkyl group, a substituted alkyl group, or an aryl group. $R_{17}$ represents a halogen atom, a nitro group, a lower alkyl group, an alkoxy group, an alkoxycarbonyl group, an alkylsulfonyl group, or an arylsulfonyl group. $R_{19}$, $R_{20}$, and $R_{21}$ each represents a hydrogen atom, a halogen atom, an alkyl group, a cycloakyl group, an aryl group, a pyridyl group, a carboxyl group, or an alkoxycarbonyl group. Q represents atoms completing a 5- or 6-membered heterocyclic nucleus such as rhodanine, 2-thioxazolidinedione, 2-thiohydantoin, barbituric acid and so one.

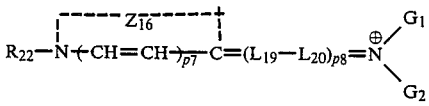

Formula (K)

$(X_5^{\ominus})_{n5-1}$

In formula (K), $R_{22}$, $Z_{16}$, and $L_{19}$ and $L_{20}$ each have the same meanings as $R_1$, $Z_1$, and $L_1$, respectively. $p_7$ represents 0 or 1, and $p_8$ represents 1, 2, or 3. $G_1$ and $G_2$ may be the same or different, and they each may have the same meanings as $R_1$, or the combination thereof can represent atoms forming a cyclic secondary amine (e.g., pyrrolidone, 3-pyrroline, piperidine, piperazine, morpholine, 1,2,3,4-tetrahydroquinoline, decahydroquinoline, 3-azabicyclo[3,2,2]nonane, indoline, azetine and hexahydroazepine). $X_5\ominus$ and $n_5$ have the same meanings as $X_1\ominus$ and $n_1$, respectively.

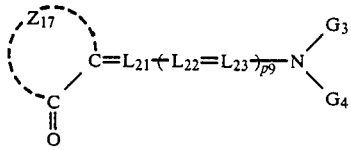

Formula (L)

In formula (L), $Z_{17}$ has the same meaning as $Z_4$. $L_{21}$, $L_{22}$ and $L_{23}$ each has the same meaning as $L_1$, and $G_3$ and $G_4$ each has the same meaning as $G_1$. $p_9$ represents 0, 1, 2, or 3.

Particularly useful dyes for imparting infrared sensitivity to silver halide grains are those represented by the following formulae (M) to (U), (W) and (Y).

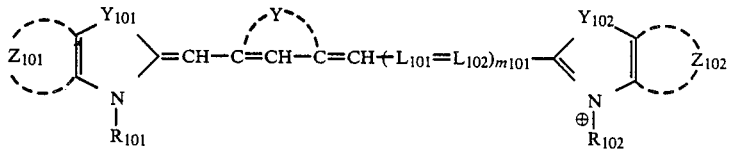

Formula (M)

$(X_{101}^{\ominus})_{m102}$

In formula (M), $R_{101}$ and $R_{102}$ may be the same or different, and they each represents an alkyl group (preferably those having from 1 to 8 carbon atoms, such as methyl, ethyl, propyl, butyl, pentyl, heptyl, etc.) or a substituted alkyl group, the alkyl moiety of which has not more than 6 carbon atoms and is substituted with one or more of a group selected from among carboxyl, sulfo, cyano, halogen (e.g., fluorine, chlorine, bromine, etc.), hydroxy, alkoxycarbonyl (those having not more than 8 carbon atoms, such as methoxycarbonyl, ethoxycarbonyl, benzyloxycarbonyl, etc.), an alkoxy (those having not more than 8 carbon atoms, such as methoxy, ethoxy, propoxy, butoxy, benzyloxy, etc.), aryloxy (e.g., phenoxy, p-tolyloxy, etc.), acyloxy (those having not more than 3 carbon atoms, such as acetyloxy, propionyloxy, etc.), acyl (those having not more than 8 carbon atoms, such as acetyl, propionyl, benzoyl, mesyl, etc.), carbamoyl (e.g., carbamoyl, N,N-dimethylcarbamoyl, morpholinocarbamoyl, piperidinocarbamoyl, etc.), sulfamoyl (e.g., sulfamoyl, N,N-dimethylsulfamoyl, morpholinosulfamoyl, etc.), aryl (e.g., phenyl, p-hydroxyphenyl, p-carboxyphenyl, p-sulfophenyl, α-naphthyl, etc.) and so on.

In the foregoing formula (M), $Y_{101}$ and $Y_{102}$ each represents an oxygen atom, a sulfur atom, a selenium atom,

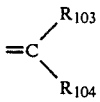

(wherein $R_{103}$ and $R_{104}$ each represents a methyl group or an ethyl group), =N—$R_{105}$ [wherein $R_{105}$ represents an unsubstituted or substituted alkyl group containing not more than 5 carbon atoms [which can include a substituent group, e.g., hydroxyl, halogen, carboxyl, sulfo, alkoxy or so on), or an allyl group] or —CH=CH—.

In the foregoing formula (M), $Z_{101}$ and $Z_{102}$ each represents atoms necessary to form a substituted or unsubstituted benzene or naphthyl ring. Suitable examples of substituent groups which those rings may have include lower alkyl groups like methyl, halogen atoms, a phenyl group, a hydroxyl group, alkoxy groups containing from 1 to 4 carbon atoms, carboxyl groups, alkoxycarbonyl groups, alkylsulfamoyl groups, alkylcarbamoyl groups, acyl groups, cyano groups, trifluoromethyl groups, nitro groups, and so on.

Specific examples of nitrogen-containing heterocyclic rings formed by fusing together a $Y_{101}$-containing ring and $Z_{101}$, or a $Y_{102}$-containing ring and $Z_{102}$ include thiazole nuclei (such as benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-methyl-6-methoxybenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.), selenazole nuclei (such as benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole, etc.), oxazole nuclei (such as benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxazole, etc.), quinoline nuclei (such as 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline, etc.), 3,3-dialkylindolenine nuclei (such as 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl5-chloroindolenine, etc.), imidazole nuclei (such as 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl5-trifluoromethylbenzimidazole, 1-ethyl-5-trifluoromethylbenzimidazole, 1-ethylnaphtho[1,2-d]imidazole, etc.), and so on.

In the foregoing formula (M), Y represents atoms forming a 5- or 6-membered carbon ring, or represents a methine chain when it does not form any ring.

In the foregoing formula (M), $m_{101}$ represents 1 or 2, $X_{101}\ominus$ represents an acid residue, and $m_{102}$ represents 0 or 1, and $m_{102}$ is 0 when the dye has a betaine structure.

$L_{101}$ and $L_{102}$ each represents a methine group or a substituted methine group. Specific examples of substituted methine groups include those substituted with a lower alkyl group containing from 1 to 5 carbon atoms, a lower alkoxy group, an aryl group (which may be substituted with a halogen atom, an alkyl group containing from 1 to 4 carbon atoms, an alkoxy group containing from 1 to 4 carbon atoms, a sulfo group, a carboxyl group, and so on), an aralkyl group (such as benzyl), and so on.

Formula (N)

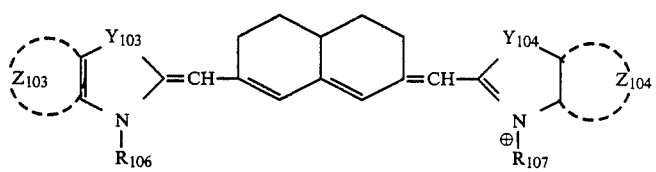

$(X_{102}\ominus)_{m103}$

In formula (N), $Y_{103}$ and $Y_{104}$ each has the same meaning as $Y_{101}$; $R_{106}$ and $R_{107}$ each has the same meaning as $R_{101}$; $Z_{103}$ and $Z_{104}$ each has the same meaning as $Z_{101}$; $X_{102}\ominus$ has the same meaning as $X_{101}\ominus$; and $m_{103}$ has the same meaning as $m_{102}$.

The expression "same meaning" as used above is intended to have the same definition as given in formula (M).

Formula (O)

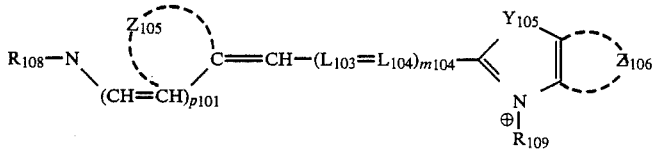

$(X_{103}\ominus)_{m105}$

In formula (O), $Z_{105}$ represents atoms necessary to complete a 4-quinoline nucleus or a 2-quinoline nucleus; $Z_{106}$ has the same meaning as $Z_{101}$; $p_{101}$ represents 0 or 1; $m_{104}$ represents 2 or 3; $Y_{105}$ has the same meaning as $Y_{101}$; $R_{108}$ and $R_{109}$ each has the same meaning as $R_{101}$; $X_{103}\ominus$ has the same meaning as $X_{101}\ominus$; $m_{105}$ has the same meaning as $m_{102}$; and $L_{103}$ and $L_{104}$ each has the same meaning as $L_{101}$.

The expression "same meaning" as used above is intended to have the same definition as given in formula (M).

Formula (P)

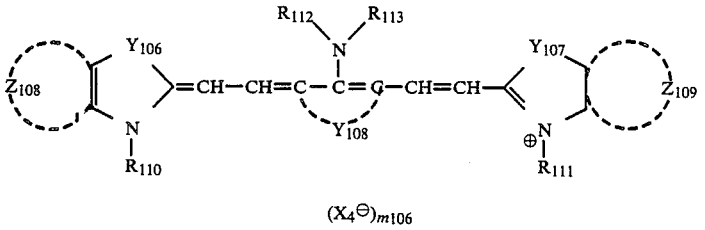

In formula (P), $Z_{108}$ and $Z_{109}$ each has the same meaning as $Z_{101}$; $R_{110}$ and $R_{111}$ each has the same meaning as $R_{101}$; $Y_{108}$ has the same meaning as Y; $X_{104}\ominus$ has the same meaning as $X_{101}\ominus$; $m_{106}$ has the same meaning as $m_{102}$; and $Y_{106}$ and $Y_{107}$ each has the same meaning as $Y_{101}$ (wherein the expression "same meaning" is intended to have the same definition as given in formula (M)).

$R_{112}$ and $R_{113}$ each represents an alkyl group containing from 1 to 4 carbon atoms or a phenyl group, or they may represent atoms forming a 5- or 6-membered heterocyclic ring by combining with each other.

Formula (Q)

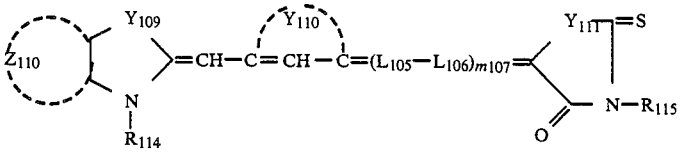

In formula (Q), $Z_{110}$ has the same meaning as $Z_{101}$; $Y_{109}$ has the same meaning as $Y_{101}$; $Y_{111}$ represents an oxygen atom, a selenium atom or $=N-R_{116}$ (wherein $R_{116}$ has the same meaning as $R_{105}$); $R_{114}$ has the same meaning as $R_{101}$; $R_{115}$ can have the same meaning as $R_{101}$ but also can represent a phenyl group, a pyridyl group, a substituted phenyl group or a substituted pyridyl group (substituent groups of which include a sulfonyl group, a carboxyl group, a cyano group, halogen atoms (e.g., chlorine, bromine, fluorine, etc.), alkyl groups containing from 1 to 4 carbon atoms, alkoxy groups containing from 1 to 4 carbon atoms, dialkylamino groups, acyl groups, alkoxycarbonyl groups and so on); $Y_{110}$ has the same meaning as Y; $m_{107}$ has the same meaning as $m_{101}$; and $L_{105}$ and $L_{106}$ each has the same meaning as $L_{101}$.

(The expression "same meaning" as used above is intended to have the same definition as given in formula (M)).

Formula (R)

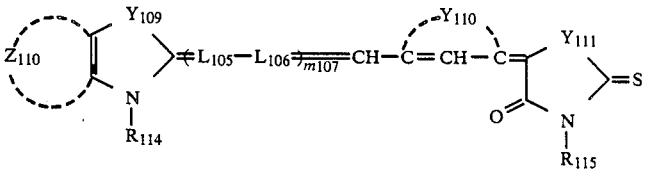

In formula (R), $Z_{110}$, $Y_{109}$, $Y_{110}$, $Y_{111}$, $R_{114}$, $R_{115}$, $L_{105}$, $L_{106}$ and $m_{107}$ have the same meanings as those in formula (Q), respectively.

Formula (S)

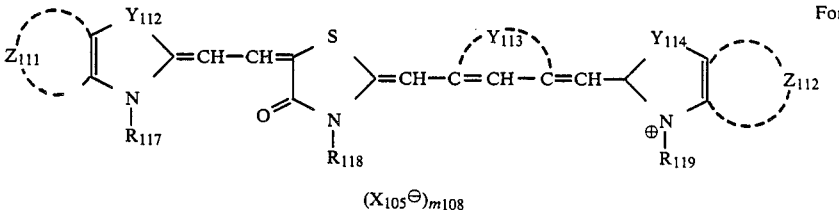

In formula (S), $Z_{111}$ and $Z_{112}$ each has the same meaning as $Z_{101}$; $Y_{112}$ and $Y_{114}$ each has the same meaning as $Y_{101}$; $R_{117}$ and $R_{119}$ each has the same meaning as $R_{101}$; $R_{118}$ has the same meaning as $R_{105}$; $Y_{113}$ has the same meaning as Y; $X_{105}\ominus$ has the same meaning as $X_{101}\ominus$; and $m_{108}$ has the same meaning as $m_{102}$ (wherein the expression "same meaning" is intended to have the same definition as given in formula (M)).

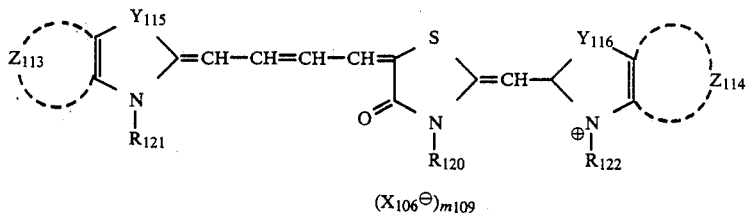

Formula (T)

In formula (T), $Z_{113}$ and $Z_{114}$ each has the same meaning as $Z_{101}$; $Y_{115}$ and $Y_{116}$ each has the same meaning as $Y_{101}$; $R_{121}$ and $R_{122}$ each has the same meaning as $R_{101}$; $X_{106}\ominus$ has the same meaning as $X_{101}\ominus$; and $m_{109}$ has the same meaning as $m_{102}$ (wherein the expression "same meaning" is intended to have the same definition as given in formula (M).

$R_{120}$ has the same meaning as $R_{118}$ defined in the description of formula (S).

In formula (Y), $Z_{119}$ and $Z_{120}$ each has the same meaning as $Z_{101}$; $Y_{121}$ and $Y_{122}$ each has the same meaning as $Y_{101}$; $R_{129}$ and $R_{130}$ each has the same meaning as $R_{101}$; $L_{108}$, $L_{109}$, $L_{110}$, $L_{111}$, $L_{112}$, $L_{113}$ and $L_{114}$ each has the same meaning as $L_{101}$; $X_{109}\ominus$ has the same meaning as $X_{101}\ominus$; and $m_{112}$ has the same meaning as $m_{102}$ (wherein the expression "same meaning" is intended to have the same definition in formula (M)).

According to the present invention, the above sensitizing dye is present in a process of formation of a dispersion of silver halide grains or a process of physical ripening of silver halide grains. In practicing the present invention, the above-illustrated sensitizing dyes may be present in the reaction system of a water-soluble silver salt (e.g., silver nitrate) and a halogenide (e.g., potassium bromide) either before formation of silver halide grains according to U.S. Pat. No. 4,183,756, or after nucleation of silver halide grains and before conclusion of the silver halide grain-forming process (i.e., during the physical ripening) according to U.S. Pat. No. 4,225,666. In addition, the sensitizing dyes may be allowed to be present in the reaction solution simultaneously with the formation of silver halide grains, that is, simultaneously with mixing of a soluble silver salt with a halogenide. This method is particularly advantageous in view of the fact that a photosensitive material containing the thus made emulsion is more superior in

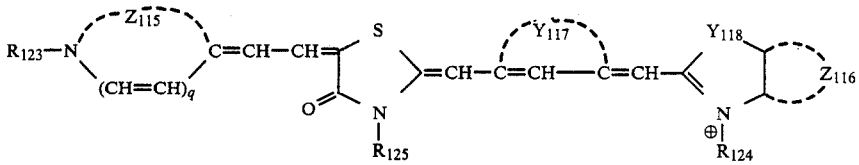

Formula (U)

In formula (U), $Y_{117}$ has the same meaning as Y; $Y_{118}$ has the same meaning as $Y_{101}$; $Z_{115}$ has the same meaning as $Z_{105}$ in the formula (O); $Z_{116}$ has the same meaning as $Z_{101}$; $R_{123}$ and $R_{124}$ each has the same meaning as $R_{101}$; q represents 0 or 1; $X_{107}\ominus$ has the same meaning as $X_{101}\ominus$; and $m_{110}$ has the same meaning as $m_{102}$ (wherein the expression "same meaning" is intended to have the same definition as given in formula (M)).

$R_{125}$ has the same meaning as $R_{118}$ defined in the description of formula (S).

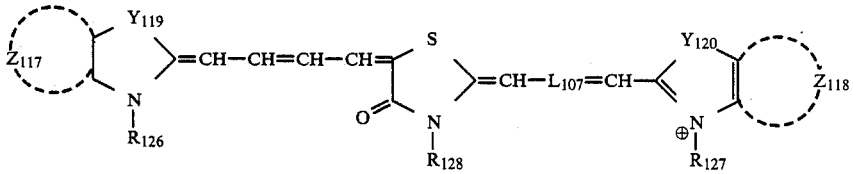

Formula (W)

In formula (W), $Z_{117}$ and $Z_{118}$ each has the same meaning as $Z_{101}$; $Y_{119}$ and $Y_{120}$ each has the same meaning as $Y_{101}$; $R_{126}$ and $R_{127}$ each has the same meaning as $R_{101}$; $X_{108}\ominus$ has the same meaning as $X_{101}\ominus$; $m_{111}$ has the same meaning as $m_{102}$; and $L_{107}$ has the same meaning as $L_{101}$ (wherein the expression "same meaning" is intended to have the same definition as given in formula (M)).

$R_{128}$ has the same meaning as $R_{118}$ in formula (S).

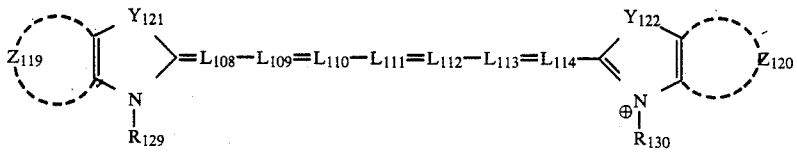

Formula (Y)

gradation and in keeping quality under high temperature conditions.

In any of the above-described addition methods, the total amount of sensitizing dye to be employed may be added either totally at one time, or at several times in portions. Moreover, the dyes may be added in the form of a mixture with a soluble silver salt and/or a halogenide.

A single kind of sensitizing dye may be employed, or two or more kinds of sensitizing dyes may be used together. In the latter case, they may all be added together in the form of mixture, or they may be added separately, or the time for adding them may be staggered with one kind at a time being added. The combined use of two or more kinds of sensitizing dyes may include the use of supersensitizing dyes.

The dyes can be added either onto the liquid surface or into the liquid. The stirring can be carried out using any conventional stirring means.

The sensitizing dyes may be added in the form of solution dissolved in an organic solvent compatible with water, such as methanol, ethanol, propanol, fluorinated alcohol, methyl cellosolve, dimethylformamide, acetone, etc., or water (alkaline or acidic). The above-described solvents may be used alone or as a combination of two or more thereof. Also, the sensitizing dyes may be added in the form of dispersion dispersed in a water/gelatin dispersion system or in the form of powder obtained by freeze-drying. In addition, the powder dispersed with a surface active agent may be added in the form of solution.

A generally suitable addition amount of the sensitizing dyes is from 0.001 to 20 g, and preferably the amount is from 0.01 to 2 g, per 100 g of silver to be used for making an emulsion.

A generally suitable concentration of the sensitizing dyes in a reaction solution used at the stage of forming silver halide grains is 1 wt % or less, and preferably 0.1 wt % or less.

Sensitizing dyes of the same or different kinds, or supersensitizing agents may further be added during chemical ripening of the silver halide emulsion prepared in the present invention, or during another step to be carried out before coating of the emulsion.

Examples of supersensitizing agents which can be used include aminostyryl compounds substituted with nitrogen-containing heterocyclic groups (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds and so on. Combinations as described in U.S. Pat. Nos. 3,615,613, 3,615,641, 3,617,295 and 3,635,721 are particularly useful.

Any organic silver salts conventionally used in heat-developable light-sensitive materials can be used in the present invention. One example of a useful organic silver salt is a silver salt of an organic compound having a carboxyl group, such as the silver salts of aliphatic carboxylic acids and aromatic carboxylic acids.

The silver salts of aliphatic carboxylic acids include the silver salts of behenic acid, stearic acid, oleic acid, lauric acid, capric acid, myristic acid, palmitic acid, maleic acid, fumaric acid, tartaric acid, furonic acid, linolic acid, oleic acid, adipic acid, sebacic acid, succinic acid, acetic acid, butyric acid, and camphoric acid. In addition, silver salts substituted with a halogen atom or a hydroxyl group are useful.

The silver salts of aromatic carboxylic acids and other carboxyl group-containing compound that can be used in the present invention include the silver salts of benzoic acid, substituted benzoic acids such as 3,5-dihydroxybenzoic acid, o-methylbenzoic acid, m-methylbenzoic acid, p-methylbenzoic acid, 2,4-dichlorobenzoic acid, acetamidobenzoic acid, and p-phenylbenzoic acid, gallic acid, tannic acid, phthalic acid, terephthalic acid, salicyclic acid, phenylacetic acid, and pyromellitic acid, the silver salts of 3-carboxymethyl-4-methyl-4-thiazoline-2-thione, for example, as described in U.S. Pat. No. 3,785,830, and the silver salts of thioether group-containing aliphatic carboxylic acids as described in U.S. Pat. No. 3,330,663.

In addition, the silver salts of mercapto or thione group-containing compounds and their derivatives can be used. These compounds include the silver salts of 3-mercapto-4-phenyl-1,2,4-triazole, 2-mercaptobenzimidazole, 2-mercapto-5-aminothiadiazole, 2-mercaptobenzothiazole, and 2-(s-ethylglycolamido)benzothiazole, the silver salts of thioglycolic acids such as s-alkylthioglycolacetic acid (wherein the alkyl group has from 12 to 22 carbon atoms) as described in Japanese Patent Application (OPI) No. 28211/73, the silver salts of dithiocarboxylic acids such as dithioacetic acid, the silver salts of thioamides, 5-carboxy-1-methyl-2-phenyl-4-thiopyridine, mercaptotriazine, 2-mercaptobenzoxazole, and mercaptooxadiazole, the silver salts described in U.S. Pat. No. 4,123,274, such as the silver salt of 3-amino-5-benzylthio-1,2,4-triazole included in a derivative of 1,2,4-mercaptotriazole, and the silver salts of thione compounds such as a 3-(2-carboxyethyl)-4-methyl-4-thiazoline-2-thione silver salt described in U.S. Pat. No. 3,301,678.

In addition, the silver salts of imino group-containing compounds can be used. These compounds include the silver salts of benzotriazole and its derivatives, such as alkyl-substituted benzotriazole (e.g., methyl benzotriazole), halogen-substituted benzotriazole (e.g., 5-chlorobenzotriazole), and carboimidobenzotriazole (e.g., butylcarboimidobenzotriazole), described in Japanese Patent Publication Nos. 30270/69 and 18416/70, the silver salt of 1,2,4-triazole and 1-H-tetrazole described in U.S. Pat. No. 4,220,709, and the silver salts of carbazole, saccharine, and imidazole and its derivatives.

In addition, the silver salts described in *Research Disclosure,* Vol. 170, June 1978, No. 17029 and organic silver salts such as copper stearate can be used in the present invention.

The above organic silver salts can be used alone or in combination with each other.

A method of preparing the above silver halide and organic silver salt and a method of mixing them are described in *Research Disclosure,* No. 170, June 1978, (RD-17029) page 9, Japanese Patent Application (OPI) Nos. 32928/75, 42529/76, U.S. Pat. No. 3,700,458, Japanese Patent Application (OPI) Nos. 13224/74 and 17216/75.

The organic silver salt can be represented by the formula $Ag^+L^-$. When the tendency of $L^-$ to be adsorbed on silver halide is high, the effect of the present invention is great. That is, organic silver salts $Ag^+L^-$, having a solubility product $[Ag^+].[L^-]$ of about $10^{-10}$ $(mol/l)^2$ or less, preferably about $10^{-11}$ $(mol/l)^2$ or less are effectively used in the present invention. Particularly preferred are the silver salts of benzotriazole compounds.

The total amount of the mixture of the lightsensitive silver halide and organic silver salt coated in the present invention is from about 1 mg/m2 to 100 g/m2 and preferably from about 10 mg/m2 to 50 g/m2 (calculated as silver).

The coverage of the organic silver salt coated is from about 0.01 to 200 mol % per mol of silver halide.

Silver halides which can be used in the present invention include silver chloride, silver chlorobromide, silver chloroiodide, silver bromide, silver iodobromide, silver chloroiodobromide, and silver iodide.

The process for preparing those silver halides is explained taking the case of silver bromide. That is, the silver bromide is prepared by first adding silver nitrate solution to potassium bromide solution to form silver bromide grains and then adding potassium iodide to the mixture.

In the present invention, silver halide grains can be prepared by known single-jet and double-jet methods. As an embodiment of the latter double-jet method, the "controlled double-jet" method can be employed, in which the pAg of the reaction solution is maintained at a constant level. In addition, the above methods can be employed in combination with each other. In any method used, the procedure used in adding the necessary ingredients is not critical; both the known one-step addition method and the multi-step addition method can be employed. The rate of addition of the ingredients is also not critical; they may be added at a constant rate, or at a rate which is changed stepwise or continuously. In the latter case, the method of changing the addition rates of the soluble silver salt and halide solutions while maintaining the concentrations of the soluble silver salt and/or the halide at constant levels, the method of changing the concentrations of the soluble silver salt and/or the halide while adding them at constant rates, or a combination of the above methods can be employed. The reaction solution can be stirred by known techniques. The temperature and pH of the reaction solution during the formation of silver halide grains are not critical. However, depending on the type of the sensitizing dye present in the reaction solution, it is desirable that the temperature and pH be chosen within such ranges that will not cause decomposition of the dye.

In the formation of the silver halide grains according to the present invention, known solvents for silver halide and crystal habit-controlling agents (e.g., ammonia, rhodane, organic thioether derivatives, thiocarbamicic acid ester derivatives, and dithiocarbamidic acid ester derivatives) can be used alone or in combination with each other.

The crystal form of silver halide grains is not critical in the present invention. Silver halide grains formed in the presence of the sensitizing dye according to the present invention are regular crystals such as cubic and octahedral crystals, or irregular crystals such as spherical and tabular crystals, or composite crystals. All these silver halide grains can be used in the present invention.

The structure of silver halide grain is not critical in the present invention. The phase of the interior of the silver halide grains may be the same or different from that of the surface layer.

The formation or physical ripening of silver halide particles may be carried out in the presence of cadmium salts, zinc salts, lead salts, thallium salts, iridium salts or iridium complex salts (e.g., iridium (III, IV) chloride and ammonium hexachloroiridium), rhodium salts or rodium complex salts (e.g., rhodium chloride), iron salts or iron complex salts, etc.

In preparing a silver halide emulsion in the present invention, it is advantageous to use gelatin as a protective colloid. In addition, other hydrophilic colloids can be used. For example, proteins such as gelatin derivatives, graft copolymers of gelatin and other polymers, albumin, and casein; sugar derivatives such as cellulose derivatives (e.g., hydroxyethyl cellulose, carboxymethyl cellulose, and cellulose sulfate) sodium alginate and starch derivatives; and synthetic hydrophilic homo- and co-polymers such as polyvinyl alcohol, partially acetalated polyvinyl alcohol, poly-N-vinyl pyrrolidone, polyacrylic acid, polymethacrylic acid, polyacrylamide, polyvinyl imidazole, and polyvinyl pyrazole can be used.

As the gelatin, lime-processed gelatin, acid-processed gelatin and enzyme-processed gelatin as described in *Bull. Soc. Sci. Phot. Japan,* No. 16, page 30 (1966) can be used. In addition, hydrolyzates and enzyme decomposition products of these gelatins can be used.

The silver halide grains which are present in the emulsion have an average grain diameter preferably from about 0.001 to 10 μm and more preferably from about 0.01 to 5 μm.

The surface and/or the interior of the silver halide grains may be chemically sensitized. For this chemical sensitization the methods described in, for example, H. Frieser ed., *Die Grundlagen der Photographischen Prozesse mit Silber-halogeniden,* pp. 675–734 (Akademische Verlagsgesellschaft, 1968) can be used. That is, a sulfur sensitization method using a sulfuric acid-containing compound capable of reacting with activated gelatin and silver, such as a thiosulfate, a thiourea, a mercapto compound, and a rhodanine; a sensitization method using selenium and tellurium compounds; a reduction sensitization method using reducing substances such as stannous salts, amines, hydrazine derivatives, formamidinesulfinic acid, and silane compounds; and a noble metal sensitization method using noble metal compounds such as gold complex salts and the complex salts of Group VIII metals (e.g., Pt, Ir, and Pd) of the Periodic Table can be used alone or in combination with each other.

The sulfur sensitization method is described in, for example, U.S. Pat. Nos. 1,574,944, 2,410,689, 2,278,947, 2,728,668, and 3,656,955; the reduction sensitization method, in, for example, U.S. Pat. Nos. 2,983,609, 2,419,974, and 4,054,458; and the noble metal sensitization method, in, for example, U.S. Pat. Nos. 2,399,083, 2,448,060, and British Patent No. 618,061.

For surface chemical sensitization of internal latent image-type silver halide grains, the method described in Japanese Patent Publication No. 34213/77 can be employed. For core/shell emulsions of this type, surface chemical sensitization which is carried out in the presence of specific polymers described in Japanese Patent Application (OPI) No. 136641/82 can be used.

In the present invention, a wide variety of image forming substances can be used in various manners.

For instance, couplers capable of producing color images by binding to oxidation products of developing agents employed in liquid development processing, which have so far been widely known, with specific examples including magenta couplers such as 5-pyrazolone couplers, pyrazolobenzimidazole couplers, cyanoacetylcumarone couplers, open chain acylacetonitrile couplers and so on, yellow couplers such as acylacetamide couplers (e.g., benzoylacetanilides, pivaloylacetanilides, etc.), and cyan couplers such as naphthol couplers and phenol couplers, can be used.

It is generally desirable that these couplers should be rendered nondiffusible by containing a hydrophobic group which acts as a ballast group in their individual molecules, or that the couplers should be polymeric ones. The couplers may be either 4-equivalent or 2-equivalent with respect to silver ion. Further, these couplers may be colored couplers having a color correction effect, or couplers capable of releasing development inhibitors upon development (so-called DIR couplers).

In addition, dyes which can produce positive color images using light-sensitive silver dye bleach processes, for example, dyes as described in *Research Disclosure,* pp. 30–32 (RD-14433) (April, 1976); ibid., pp. 14–15 (RD-15227) (December, 1976), U.S. Pat. No. 4,235,957 and so on, and leuco dyes as described in U.S. Pat. Nos. 3,985,565 and 4,022,617, can be used.

Also, dyes into which nitrogen-containing heterocyclic groups are introduced as described in *Research Disclosure,* pp. 54–58 (RD-16966) (May, 1978) can be used.

Moreover, dye-providing substances as described in European Patent No. 79,056, West German Patent No. 3,217,853 and European Patent No. 67,455, from which mobile dyes are eliminated through the coupling reaction with reducers oxidized by the redox reaction with silver halide or organic silver salts under high temperatures, and dye-providing substances described in European Patent No. 76,492, West German Patent No. 3,215,485, European Patent No. 66,282, and European Patent Applications Nos. 0120306A and 0119470A, which undergo the redox reaction with silver halide or organic silver salts under high temperatures, and release mobile dyes as a result of this reaction, can be used.

Dye-providing substances which can be used in the above-described processes are represented by formula (I)

$$D—Y \qquad (I)$$

Herein, D represents a dye moiety or a precursor thereof, and Y represents a substrate having such a function as to change the diffusibility of the dye-providing substance (I) upon the redox reaction caused in the heat development step.

The expression "change in diffusibility" is intended to include the cases wherein (1) the compound (I) is nondiffusible originally, and it is changed into diffusible one or releases a diffusible dye, and (2) the compound (I) is originally diffusible, and changed into nondiffusible one. This change is caused by oxidation of Y or reduction of Y according to the nature of Y, and this two reactions are used appropriately according to the circumstances.

As examples of Y whose diffusibility is changed by oxidation, mention may be made of the so-called dye releasing redox substrates such as p-sulfonamidonaphthols (including p-sulfonamidophenols, and specific examples thereof are described in Japanese Patent Applications (OPI) Nos. 33826/73 and 50736/78, and European Patent No. 76,492), o-sulfonamidonaphthols (including o-sulfonamidophenols, and specific examples thereof are described in Japanese Patent Applications (OPI) Nos. 113624/76, 12642/81, 16130/81, 16131/81, 4043/82 and 650/82, U.S. Pat. No. 4,053,312, and European Patent No. 76,492), hydroxysulfonamidoheterocyclic rings (with specific examples described in Japanese Patent Application (OPI) No. 104343/76 and European Patent No. 76,492), 3-sulfonamidoindoles (with specific examples described in Japanese Patent Applications (OPI) Nos. 104343/76, 46730/78, 130122/79 and 85055/82 and European Patent No. 76,492) and so on.

As examples of Y of a different type which release a dye by intramolecular nucleophilic attack after oxidation, mention may be made of intramolecular assist type substrates described in Japanese Patent Application (OPI) No. 20735/82 and European Patent Application No. 0106211A.

As examples of Y of another different type which releases a dye by an intramolecular ring closure reaction under alkaline conditions, but causes substantially no release of a dye when oxidized, mention may be made of the substrates described in Japanese Patent Application (OPI) No. 63618/76. In addition, substrates which are modifications of the above-described type of Y, and release dyes through winding change caused in an isoxazoline ring by a nucleophilic agent (specific examples of which are described in Japanese Patent Applications (OPI) No. 111628/74 and 4819/77) are also useful.

As examples of Y of still another different type, mention may be made of substrates which can release their dye moieties through dissociation of acidic proton under alkaline conditions, but cause substantially no release of dyes when oxidized (specific examples of which are described in Japanese Patent Applications (OPI) Nos. 69033/78 and 130927/79).

On the other hand, examples of Y whose diffusibility is changed by reduction include nitro compounds described in Japanese Patent Application (OPI) 110827/78 and quinone compounds described in Japanese Patent Application (OPI) No. 110827/78 and U.S. Pat. Nos. 4,356,249 and 4,358,525. These compounds are reduced by a reducer (called an electron donor) remaining without consumed in the heat development step to produce nucleophilic groups, and release dyes through the molecular attack of the resulting nucleophilic groups. Substrate of the quinone type which are modification of the above-described quinone compounds, and release their dye moieties through dissociation of acidic proton of the reductant thereof are also useful. Specific examples of such quinone type substrates are described in Japanese Patent Applications (OPI) No. 130927/79 and 164342/81. When the substrates of the kind which cause change in diffusibility by reduction, as described above, are employed, it is essential to use a proper reducer (electron donor) to mediate between a silver salt as oxidizing agent and a dye providing substance, and specific examples of suitable reducers which can be used are described in the above-described known data. In addition, substrates in which an electron donor is present (called LDA compounds) are also useful as Y.

Further, materials which undergo the redox reaction with silver halides or organic silver salts, and as a result thereof it follows that change in mobility of the products containing their dye moieties is caused can be employed as examples of another type of dye-providing substance, and specific examples thereof are described in Japanese Patent Application (OPI) No. 165054/84.

Also, materials capable of releasing mobile dyes through the reaction with silver ion present in a photosensitive material can be employed, are specific examples thereof are described in Japanese Patent Application (OPI) No. 180548/84.

Many of the above-described materials produce the imagewise distribution of mobile dyes corresponding to an exposure pattern in the photosensitive material by heat development, and the resulting image dyes are transferred into a dye-fixing material (so-called diffusion transfer) and visualized therein. Methods for effecting such procedures are described in the patents cited above or European Patent Application 0119615A and so on.

Heat-developable light-sensitive materials and a process for developing them are described in, for example, *Shashin Kogaku no Kiso* (*Fundamentals of Photographic Engineering*), Corona Co., Ltd., Tokyo, pp. 553–555 (1979), *Eizo Joho* (*Image Information*), published April 1978, page 40, *Nebletts Handbook of Photography and Reprography*, 7th Ed., Van Nostrand Reinhold Co., pp. 32–33, 1977, U.S. Pat. Nos. 3,152,904, 3,301,678, 3,392,020, 3,457,075, British Patents Nos. 1,131,108, 1,167,777, and Research Disclosure, published June 1978, pp. 9–15 (RD-17029).

When dye-providing substances are used in the present invention, they can be introduced into constituent layers of a photosensitive material using a known method, e.g., the method described in U.S. Pat. No. 2,322,027, or so on. In introducing them, high boiling point organic solvents and/or low boiling point organic solvents can be used.

Specifically, dye-providing substances are dissolved in a high boiling point solvent, such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate), benzoic acid esters (e.g., octyl benzoate), alkylamides (e.g., diethyllaurylamide), fatty acid esters (e.g., dibutoxyethyl succinate, dioctyl azelate, etc.), trimesic acid esters (e.g., tributyl trimesate) and so on, or an organic solvent having a boiling point of from about 30° C. to 160° C. such as lower alkyl acetates like ethyl acetate and butyl acetate, ethyl propionate, secondary butyl alcohol, methyl isobutyl ketone, β-ethoxyethyl acetate, methyl cellosolve acetate, cyclohexanone, and so on, and then dispersed into a hydrophilic colloid. The above-described high boiling point organic solvents and low boiling point organic solvents may be used as a mixture of two or more thereof.

Also, the dispersing methods described in Japanese Patent Publication No. 39853/76 and Japanese Patent Application (OPI) No. 59943/76, in which dispersion is carried out with the aid of polymers, can be employed. Further, in dispersing dye-providing substances into hydrophilic colloids, various kinds of surface active agents can be used.

A high boiling point organic solvent employable in the present invention is used in an amount of 10 g or less, preferably 5 g or less, per 1 g of a dye-providing substance used.

In the present invention, it is to be desired that a reducing substance should be incorporated in the photosensitive material. Suitable reducing substances include known reducing agents and the foregoing reductive dye-providing substances.

Specific examples of suitable reducing agents which can be used in the present invention include hydroquinone compounds (e.g., hydroquinone, 2,5-dichlorohydroquinone, 2-chlorohydroquinone, etc.), aminophenol compounds (e.g., 4-aminophenol, N-methylaminophenol, 3-methyl-4-aminophenol, 3,5-dibromoaminophenol, etc.), catechol compounds (e.g., catechol, 4-cyclohexylcatechol, 3-methoxycatechol, 4-(N-octadecylamino)catechol, etc.), phenylenediamine compounds (e.g., N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethylp-phenylenediamine, etc.) and so on.

Examples of more preferred reducing agents include 3-pyrazolidone compounds, such as 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone and 5-methyl-3-pyrazolidone.

Combinations of various developing agents as disclosed in U.S. Pat. No. 3,039,869 can also be employed as a reducing agent.

A generally suitable amount of a reducing agent used in the present invention ranges from 0.01 to 20 mols, and particularly preferably the amount is from 0.1 to 10 mols, per 1 mol of silver.

Binders which can be used in the present invention can be used singly or as a combination thereof. Such binders can be hydrophilic. The representative of hydrophilic binders are transparent or translucent ones, with specific examples including natural substances such as proteins (e.g., gelatin, gelatin derivatives, etc.) and polysaccharides (e.g., cellulose derivatives, starch, gum arabic, etc.), and synthetically polymerized substances such as water-soluble polyvinyl compounds (e.g., polyvinyl pyrrolidone, acrylamide polymers, etc.). Other synthetic polymers which can be used include vinyl compounds in a dispersion state which can contribute particularly to increasing dimensional stability of a photographic material when incorporated in a latex form.

In addition, compounds which can promote the activation of development and the stabilization of formed images at the same time can be employed in the present invention. Of such compounds, isothiuroniums, represented by 2-hydroxyethylisothiuronium trichloroacetate described in U.S. Pat. No. 3,301,678, bis(isothiuroniums) such as 1,8-(3,6-dioxaoctane)bis(isothiuronium trichloroacetate) and the like described in U.S. Pat. No. 3,669,670, thiol compound described in West German Patent Application (OLS) No. 2,162,714, thiazolium compounds such as 2-amino-2-thiazolium trichloroacetate, 2-amino-5-bromoethyl-2-thiazolium trichloroacetate and the like described in U.S. Pat. No. 4,012,260, compounds having as their acidic moieties 2-carboxycarboxyamido group such as bis(2-amino-2-thiazolium)methylenebis(sulfonylacetate), 2-amino-2-thiazoliumphenylsulfonylacetate, etc., described in U.S. Pat. No. 4,060,420, and so on, are more preferably used.

Further, azole thioether and blocked azolinethione compounds described in Belgian Patent No. 768,071, 4-aryl-1-carbamyl-2-tetrazoline-5-thione compounds described in U.S. Pat. No. 3,893,859, and other compounds described in U.S. Pat. Nos. 3,839,041, 3,844,788 and 3,877,940 can also be used preferably.

The photosensitive material of the present invention can contain a toning agent as occasion arises. Effective toning agent are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

In the light-sensitive material of the present invention, various dye-releasing activators can be used. These dye-releasing activator are compounds which are basic and are capable of activating development, or compounds having so-called nucleophilic properties. That is, bases or base precursors can be used.

These dye-releasing activators can be used in any of the light-sensitive material and the dye-fixing material. When the dye-releasing aid is introduced in the light-sensitive material, it is advantageous to use a base precursor as the dye-releasing activators. The term "base precursor" as used herein means a compound releasing a base component on heating; the base component may be an inorganic base or an organic base.

Suitable examples of inorganic base include hydroxides, secondary or tertiary phosphates, borates, carbonates, quinolinates and metaborates of alkali metals or alkaline earth metals; ammonium hydroxide; hydroxides of quaternary alkylammoniums; hydroxides of other metals; and so on. Examples of organic base include aliphatic amines (such as trialkylamines, hydroxylamines and aliphatic polyamines), aromatic amines (such as N-alkyl-substituted aromatic amines, N-hydroxylalkyl-substituted aromatic amines, and bis[p-(dialkylamino)phenyl]methanes), heterocyclic amines, amidines, cyclic amidines, quanidines, and cyclic guanidines. In addition, betaine iodotetramethyl ammonium and diaminobutane dihydrochloride described in U.S. Pat. No. 2,410,644, and organic compounds containing urea or amino acid, such as 6-aminocaproic acid described in U.S. Pat. No. 3,506,444 can be used to advantage. Of these base, those having pKa of 8 or higher are particularly useful in the present invention.

Compounds which can undergo a certain reaction upon heating to release a base, for instance, salts of organic acid and base which are decomposed through decarboxylation upon heating, compounds which are decomposed by Lossen rearrangement, Beckmann rearrangement or so on, to result in release of amines, and so on can be employed as the base precursor of the present invention.

As examples of preferred base precursors, mention may be made of precursors of the above-described organic ease. More specifically, salts of pyrolyzable organic acids, such as trichloroacetic acid, trifluoroacetic acid, propiolic acid, cyanoacetic acid, sulfonylacetic acid, acetoacetic acid and the like, salts of 2-carboxycarboxamides described in U.S. Pat. No. 4,088,496, and so on are preferred.

Specific examples of preferred base precursors are described below. As examples of compounds which are supposed to release an base through decarboxylation in their acid moieties, mention may be made of the following.

Trichloroacetic acid derivatives include guanidinotrichloroacetic acid, piperidinotrichloroacetic acid, morpholinotrichloroacetic acid, p-toluidinotrichloroacetic acid, 2-picolinotrichloroacetic acid and the like.

In addition, base precursors described in British Patent No. 998,945, U.S. Pat. No. 3,220,846, Japanese Patent Application (OPI) No. 22625/75 and so on can be used.

Besides trichloroacetic acid derivatives, there can be cited 2-carboxycarboxamide derivatives described in U.S. Pat. No. 4,088,496, α-sulfonylacetate derivatives described in U.S. Pat. No. 4,060,420, and basic salts of propiolic acid derivatives described in European Patent Application No. 0123937A.

Salts which contain as an basic component an alkali metal or in alkaline earth metal, other than an organic alkali, can be used effectively, and such salts are described, e.g., in European Patent Application No. 0125521A.

In addition to the above-described precursors, hydroxamcarbamates described in European Patent Application No. 0120661A, in which Lossen rearrangement is utilized, aldoxime carbamates capable of producing nitrile, which are described in European Patent Application No. 0118078A, and so on can also be used effectively.

Moreover, amine imides as described in *Research Disclosure,* RD-15776 (May, 1977) and aldone amides as described in Japanese Patent Application (OPI) No. 22625/75, which decompose at high temperatures to produce bases, can be used advantageously.

Among the basic agent and the base precursor, an organic base and an organic base precursor are preferred.

The base or the base precursor in the present invention can be used in a very wide range of addition amount. A useful coverage range thereof is 50 wt % or less, and more preferably the concentration range is from 0.01 to 40 wt %, based on the total weight dried coatings of the photosensitive material.

The above-described bases or base precursors can be used not only for the acceleration of dye release but also for other purposes such as the control of a pH value.

The above-described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above-described manner, migration of additives among constituent layers of a heat developable photosensitive material can be reduced. Therefore, such distribution of additives is of advantage to some cases.

The heat developable photosensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various kinds of exposure means can be employed in the present invention. Latent images can be obtained by imagewise exposure to radiant rays containing visible rays. In general, conventionally used light sources including sunlight, storobe, a flash bulb, a tungsten lamp, a mercury lamp, a-halogen lamp like an iodine lamp, a xenon lamp, a laser beam, a CRT (cathode ray tube) light source, a plasma light source, a fluorescent tube, a light emission diode and so on can be employed for the exposure.

The development is carried out by application of heat to a photosensitive material in the present invention. A hot plate, an iron, a hot roller, or an exothermic body which utilizes carbon or titanium white or its analogs may be employed as a heat applying means.

A support to be used for the photosensitive material in the present invention and for a dye-fixing material which may be employed in the present invention according to circumstances is one which can withstand processing temperatures. Examples of supports which can be generally used include not only glass, paper, metals and their analogs, but also an acetyl cellulose film, a cellulose ester film, a polyvinyl acetal film, a polystyrene film, a polycarbonate film, a polyethylene terephthalate film and their related films or resinous materials. Also, a paper support laminated with a polymer like polyethylene or so on can be used. Further, polyesters described in U.S. Pat. No. 3,634,089 and 3,725,070 are used to advantage.

Photographic emulsion layer and other binder layers, which can constitute the photographic material and the dye-fixing material of the present invention, may contain an inorganic or organic hardener. Specifically, chromium salts (e.g., chrome alum, chromium acetate, etc ), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen-containing compounds (e.g., 2,4-dichloro-6-hydroxy-s-triazine, etc.), mucohalogeno acids (e.g., mucochloric acid, mucophenoxychloric acid, etc.) and so on can be used alone or in combination.

When dye-providing substances capable of releasing mobile dyes in imagewise distribution are employed in the present invention, a dye transfer assistant can be utilized in transferring the released dyes from the photosensitive layers into the dye-fixing layer Examples of dye transfer assistants which can be employed in an externally supplied form include water and basic water solutions containing sodium hydroxide, potassium hydroxide, or an inorganic alkali metal salt In addition, low boiling point solvents such as methanol, N,N-dimethylformamide, acetone, diisobutyl ketone and the like, or mixed solutions prepared from these low boiling point solvents and water or basic aqueous solutions can also be used. The dye transfer assistants may be used in such a manner that an image-receiving layer is dampened therewith.

If the transfer assistant is incorporated inside the photosensitive material or the dye-fixing material, it is unnecessary to supply the transfer assistant externally. The above-described transfer assistants may be incorporated inside the material in the form of crystal water or microcapsules, or as precursors capable of releasing the above-described solvents under high temperatures. It is more desirable to incorporate a hydrophilic thermal solvent, which is in a solid state at ordinary temperature and can be fused under high temperatures, into the photosensitive material or the dye-fixing material. Such a hydrophilic thermal solvent may be incorporated into either the photosensitive material or the dye-fixing material, or may be incorporated into both materials. In addition, such a solvent may be incorporated into any constituent layer, an emulsion layer, an interlayer, a protective layer or a dye-fixing layer. However, incorporation into a dyefixing layer and/or its adjacent layers can produce better results.

Examples of suitable hydrophilic thermal solvents which can be used include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mordants and so on, are those described in European Patent Nos. 76,492 and 66,282, West German Patent No. 3,315,485, and Japanese Patent Application No. 28928/83 (corresponding to U.S. patent application Ser. No. 582,655 filed on Feb. 23, 1984) and U.S. Pat. No. 4,503,137. Methods for the exposure and so on cited in the abovedescribed patents can be employed in the present invention also.

The present invention is described in greater detail with reference to the following examples, although the invention is not to be construed as being limited thereto. Unless otherwise indicated, all parts, percents and ratios are by weight.

EXAMPLE 1

Preparation of Silver Iodobromide Emulsion (A)

24 g of gelatin, 1 g of potassium bromide, and 10 ml of 25% aqueous ammonia were dissolved in 1,000 ml of water to prepare a solution (Solution II). This solution was stirred at 50° C., while a solution of 100 g of silver nitrate dissolved in 1,000 ml of water (Solution (a)) and a solution of 63 g of potassium bromide and 12 g of potassium iodide dissolved in 1,000 ml of water (Solution (b)) were added simultaneously to solution II over 50 minutes.

The thus-formed silver iodobromide emulsion was precipitated and freed of excessive salts. Then, 70 g of water and 12 g of gelatin were added to the emulsion, and the pH of the emulsion was adjusted to 6.0. Subsequently the emulsion was subjected to gold sensitization and sulfur sensitization to yield a silver iodobromide emulsion (Emulsion (A); yield: 400 g).

Preparation of Silver Iodobromide Emulsion (B)

A silver iodobromide emulsion (Emulsion (B)) was prepared in the same manner as in the preparation of the emulsion (A) except that when solutions (a) and (b) were added, a solution of 0.02 g of Dye (I) in 300 ml of methanol was added at the same time over 50 minutes (yield: 400 g).

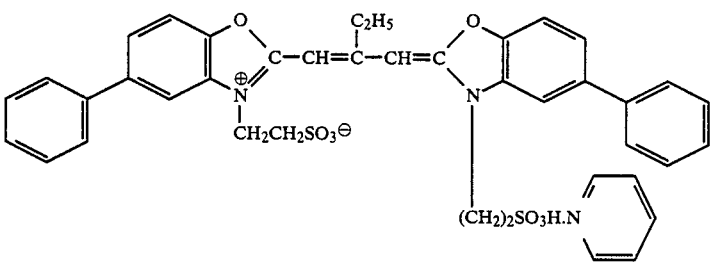

Dye (I)

Preparation of Silver Benzotriazole Emulsion 28 g of gelatin and 13.2 g of benzotriazole were dissolved in 3,000 ml of water. The resulting solution was stirred at 40° C., while solution of 17 g of silver nitrate dissolved in 100 ml of water was added over 2 minutes.

The thus-formed silver benzotriazole emulsion was precipitated and freed of excessive salts. Then the pH of the emulsion was adjusted to 6.0 to yield the desired silver benzotriazole emulsion (yield: 400 g).

Preparation of Light-Sensitive Material 101

4 g of emulsion (A) was melted and a solution of 0.0002 g of Dye (I) dissolved in 3 ml of methanol was added thereto. The resulting mixture was allowed to stand for. Then, 10 g of the above-prepared silver benzotriazole emulsion, 1 g of an emulsion containing a coupler (I) as shown below, a solution of 100 mg of 2,6-dichloro-p-aminophenol dissolved in 1 ml of methanol, and 4 ml of a 5 wt % aqueous solution of Compound (1) having a formula as shown below were added. The resulting mixture was coated on a polyethylene terephthalate film in a wet thickness of 60 μm and then dried to prepare a light-sensitive material (Light-Sensitive Material 101).

Preparation of Light-Sensitive Material 102

A light-sensitive material (Light-Sensitive Material 102) was prepared in the same manner as light-sensitive material 101 except that emulsion (B) was used in place of the emulsion (A) and the methanol solution of Dye (I) was not added.

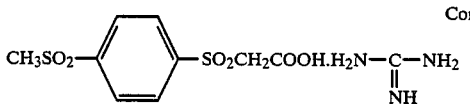

Compound (1)

Preparation of Emulsion containing Coupler (I)

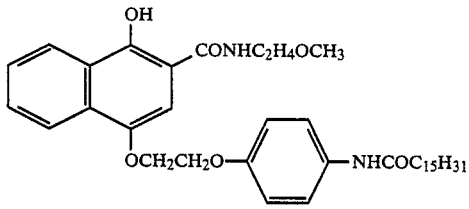

Coupler (I)

The emulsion containing the above coupler (I) was prepared as follows:

0.5 g of sodium dodecylbenzenesulfonate was added to 100 g of a 10% aqueous solution of gelatin which had been dissolved at 40° C. and then dissolved therein by stirring. A mixture of 10 g of the above coupler (I), g of tricresyl phosphate, and 20 ml of ethyl acetate was dissolved in the above-prepared solution while heating. The gelatin solution containing the surface active agent and the solution containing the coupler (I) were emulsified for 3 minutes at 12,000 r.p.m. by means of a homogenizer to prepare an emulsion of the coupler.

The light-sensitive materials 101 and 102, immediately after being prepared were each exposed to light through a green filter and a wedge filter for 4 seconds at 2,000 lux using a tungsten lamp and then heated evenly for 30 seconds on a heat block maintained at 140° C.

In addition, samples of light-sensitive materials 101 and 102 were each allowed to stand at 40° C. for one day, and then were exposed and processed in the same manner as above.

Preparation of Image-Receiving Material 10 g of a methyl acrylate/N,N,N-trimethyl-N-vinylbenzylammonium chloride (1/1) copolymer (molecular weight: 10,000 was dissolved in 200 ml of water and then uniformly mixed with 100 g of 10% aqueous lime-processed gelatin. The resulting mixture was coated evenly on a polyethylene terephthalate film in a wet thickness of 20 μm and then dried to prepare the desired image-receiving material.

The thus-prepared image-receiving material was dipped in water and then placed on the light-sensitive material which had been heated, in such a manner that their coated surface were in contact with each other. Subsequently they were heated for 6 seconds on a heat block maintained at 80° C. Then the image-receiving material was peeled apart from the light-sensitive material, whereupon a negative cyan dye image was obtained which was sharp and free from turbidity.

The sensitivity of the color image was measured and expressed using for comparison of the sensitivity light-sensitive material 101 immediately after preparation defined as 100. The results are shown in Table 1 below.

TABLE 1

| Light-Sensitive Material | Sensitivity: Immediately after Coating | Sensitivity: After standing at 40° C. for 1 day |
|---|---|---|
| 101 (Comparative Examples) | 100 | 60 |
| 102 (Example of the Present Invention) | 107 | 105 |

It can be seen from the results shown in Table 1 that the effect improving the storage stability of the present invention can be obtained.

EXAMPLE 2

Preparation of Silver Chlorobromide Emulsion (C)

A solution of 50 g of silver nitrate dissolved in 400 ml of water and 400 ml of a solution containing 19 g of potassium bromide and 8 g of sodium chloride were added at the same time in an amount of 20 ml per minute to 800 ml of an aqueous solution containing 5 g of sodium chloride and 20 g of gelatin while maintaining the aqueous solution at 55° C.

Thereafter, a precipitating agent was added to remove excessive salts. The resulting emulsion was adjusted to pH 6.3, and 5 ml of a 0.01% solution of trimethylthiourea was added. The resulting mixture was maintained at 55° C. for 30 minutes to effect sulfur sensitization. The yield was 500 g.

Preparation of Silver Chlorobromide Emulsion (D)

A silver chlorobromide emulsion (D) was prepared in the same manner as silver chlorobromide emulsion (C) except that when adding the silver nitrate solution and the solution of the potassium bromide/sodium chloride mixture, a solution of 0.01 g of Dye (I) dissolved in 300 ml of methanol was added at the same time over 20 minutes.

Preparation of Silver Benzotriazole Emulsion 28 g of gelatin and 13.2 g of benzotriazole were dissolved in 3,000 ml of water and then stirred at 40° C., while a solution of 17 g of silver nitrate dissolved in 100 ml of water was added over 2 minutes. The thus-prepared silver benzotriazole emulsion was precipitated to remove excessive salts. Then the pH of the emulsion was adjusted to 6.0 to yield the desired silver benzotriazole emulsion (yield: 400 g).

Preparation of Light-Sensitive Material (Negative Sheet)

| | | |
|---|---|---|
| (a') | Silver chlorobromide emulsion (C) | 20 g |
| (b') | Methanol containing 0.0004 g of Dye (I) | 14 ml |
| (c') | Silver benzotriazole emulsion | 20 g |
| (d') | 1% Aqueous solution of sodium succinate-2-ethylhexylsulfonate | 2 ml |
| (e') | 10% Methanol solution of 1-phenyl-3-pyrazolidone | 2 ml |

The above ingredients (a') to (e') were mixed and dissolved by heating. The resulting solution was coated on a 180 μm thick polyethylene terephthalate film in a wet thickness of 80 μm.

| | | |
|---|---|---|
| (f') | 10% Aqueous solution of gelatin | 30 g |
| (g') | 1% Aqueous solution of sodium succinate-2-ethylhexylsulfonate | 10 ml |
| (h') | Water | 60 ml |

The above ingredients (f') to (h') were mixed and then coated as a protective layer on the light-sensitive emulsion layer in a wet thickness of 40 μm to produce a light-sensitive material (negative sheet) N-1.

A light-sensitive material N-2 was prepared in the same manner as light-sensitive material N-1 except that silver chlorobromide emulsion (D) was used in place of silver chlorobromide emulsion (C) and the methanol solution of Dye (I) was not added.

Preparation of Silver Salt-Fixing Sheet (Positive Sheet) P-1

| | | |
|---|---|---|
| (a'') | 10% Aqueous solution of polyvinyl alcohol (degree of polymerization: 500) | 20 g |
| (b'') | Urea | 3.2 g |
| (c''). | N—methylurea | 4.8 g |
| (d'') | Water | 15 ml |
| (e'') | Ethanol | 5 ml |
| (f'') | Hydro sulfate (Hypo) | 0.4 g |
| (g'') | 1-Phenyl-3-pyrazolidone | 0.4 g |
| (h'') | Colloidal silver sulfide dispersion (silver sulfide: 0.05 g) | 5 g |
| (i'') | 1% Aqueous solution of sodium succinate-2-ethylhexylsulfonate | 2 ml |

The above ingredients (a'') to (i'') were mixed and dissolved, and the resulting solution was coated on a white polyethylene terephthalate film containing $TiO_2$ in a wet thickness of 60 μm and dried to produce a positive sheet P-1.

The light-sensitive materials N-1 and N-2 immediately after being prepared were each exposed to light through a green filter and a stepwise wedge for 4 seconds at 5,000 lux using a tungsten lamp. Then positive sheet P-1 was placed on each material in such a manner that their coated surface were contact with each other. They were then passed through a hot roller maintained at 130° C. and then heated for 60 seconds on a heat block.

When the positive sheet was peeled apart immediately after heating, a black brown positive image was formed on the positive sheet.

Additional samples of light-sensitive materials N-1 and N-2 were each allowed to stand at 40° C. for 1 day and then exposed and processed in the same manner as above. Also in this case, a black brown positive image was formed on the positive sheet.

The sensitivity of the positive image was determined by the use of a reflection-type automatic densitometer. The results are shown in Table 2.

TABLE 2

| | Sensitivity* | |
|---|---|---|
| Light-Sensitive Material | Immediately after Coating | After allowing to stand at 40° C. for 1 Day |
| N-1 (Comparative Example) | 100 | 70 |
| N-2 (Example of the Present Invention) | 110 | 103 |

Note:
*Relative values with the sensitivity of the light-sensitive material N-1 immediately after preparation defined as 100.

It can be seen from the results shown in Table 2 that the effect improving the storage stability of the present invention can be obtained also in a diffusion transfer heat-developable light-sensitive material using a silver salt.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having thereon at least a light-sensitive silver halide emulsion, an organic silver salt of a benzotriazole compound having a solubility product of less than about $10^{-10}$, and a gelatin binder wherein silver halide grains in the silver halide emulsion are formed in the presence of a sensitizing dye.

2. A heat-developable light-sensitive material as claimed in claim 1, wherein said sensitizing dye is selected from the group consisting of a cyanine dye, a merocyanine dye, a complex cyanine dye, a complex merocyanine dye, a holopolar cyanine dye, a hemicyanine dye, a styryl dye, and a hemioxonol dye.

3. A heat-developable light-sensitive material as claimed in claim 2, wherein said sensitizing dye is selected from the group consisting of a cyanine dye, a merocyanine dye and a complex merocyanine dye, said dye containing a basic heterocyclic nucleus selected from the group consisting of a pyrroline nucleus, an oxazoline nucleus, a thiazoline nucleus, a pyrrole nucleus, an oxazole nucleus. a thiazole nucleus, a selenazole nucleus, an imidazole nucleus, a tetrazole nucleus, a pyridine nucleus, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus.

4. A heat-developable light-sensitive material as claimed in claim 1, wherein the concentration of said organic silver salt present is from about 0.01 to 200 mol % per mol of silver halide, and the total amount of said lightsensitive silver halide and said organic silver salt present is from about 1 mg/m$^2$ to 100 g/m$^2$.

5. A heat-developable light-sensitive material as claimed in claim 1, wherein said silver halide grains are formed by adding said sensitizing dye to a reaction system containing a soluble silver salt and a halide, wherein the amount of said sensitizing agent added is from 0.001 to 20 g per 100 g of silver present in said reaction system.

6. A heat-developable light-sensitive material as claimed in claim 5, wherein the amount of said sensitizing agent added is from 0.01 to 2 g per 100 g of said silver present.

7. A heat-developable light-sensitive material as claimed in claim 1, wherein said silver halide grains are formed by adding said sensitizing dye to a reaction system containing a soluble silver salt and a halide, wherein the amount of said sensitizing agent added is from 0.001 to 20 g per 100 g of silver present in said reaction system, and the concentration of said sensitizing dye in said reaction system during the formation of silver halide particles is about 0.1 weight percent or less.

* * * * *